US006963311B1

(12) United States Patent
Enns

(10) Patent No.: US 6,963,311 B1
(45) Date of Patent: Nov. 8, 2005

(54) APPARATUS AND METHOD FOR LOCKING AN ANTENNA INTO POSITION

(75) Inventor: Frederick Enns, Menlo Park, CA (US)

(73) Assignee: Extreme Networks, Inc., Santa Clara, CA (US)

( * ) Notice: Subject to any disclaimer, the term of this patent is extended or adjusted under 35 U.S.C. 154(b) by 0 days.

(21) Appl. No.: 10/759,467

(22) Filed: Jan. 15, 2004

Related U.S. Application Data

(63) Continuation of application No. 10/461,734, filed on Jun. 13, 2003, now abandoned.

(51) Int. Cl.[7] ..... H01Q 1/24
(52) U.S. Cl. ..... 343/702; 343/906; 455/89
(58) Field of Search ..... 343/702, 880, 343/882, 901, 906; 455/89, 90

(56) References Cited

U.S. PATENT DOCUMENTS 3,950,758 A 4/1976 Mirrione et al.
5,157,409 A 10/1992 Hamin
5,168,278 A * 12/1992 Morita ..... 343/702
5,710,567 A 1/1998 Funke
5,856,806 A 1/1999 Koleda
5,909,653 A * 6/1999 Imura et al. ..... 455/575.7
6,075,499 A 6/2000 Edwards et al.
6,166,707 A 12/2000 Painter et al.
6,326,928 B1 12/2001 Kitamura et al.
6,359,591 B1 3/2002 Mou
6,758,689 B1 * 7/2004 Bair et al. ..... 439/136
6,762,725 B2 * 7/2004 Beard et al. ..... 343/702
6,853,353 B2 * 2/2005 Wang et al. ..... 343/901
2005/0030252 A1 * 2/2005 Peng ..... 343/906

* cited by examiner

*Primary Examiner*—Tho Phan
(74) *Attorney, Agent, or Firm*—Blakely, Sokoloff, Taylor & Zafman LLP

(57) ABSTRACT

An antenna locking mechanism for locking an antenna of a wireless networking device at a desired position. A method of locking an antenna into position is also disclosed.

27 Claims, 13 Drawing Sheets

APPARATUS AND METHOD FOR LOCKING AN ANTENNA INTO POSITION

The present patent application is a Continuation of application Ser. No. 10,461,734, filed Jun. 13, 2003, now abandoned.

FIELD OF THE INVENTION

The invention relates generally to wireless networking and, more particularly, to an apparatus and method for locking an antenna into position.

BACKGROUND OF THE INVENTION

Traditionally the mainstay of mobile communication devices, wireless connectivity is now making inroads in other networking environments, such as enterprise networks, where wireless networking can provide a more flexible and lower cost alternative to the installation of hard-wired networking infrastructure. Wireless connectivity may be found in a variety of networking environments, including personal area networks (PAN), local area networks (LAN), and even in wide area networks (WAN). A number of wireless networking technologies have been developed, including Bluetooth™, the wireless networking technologies defined in the IEEE (Institute of Electrical and Electronics Engineers) 802.11 family of specifications, as well as the General Packet Radio Service (GPRS). In addition to traditional networking, wireless connectivity is enabling new applications that were not previously feasible in many conventional hard-wire networks, including asset tracking, patient tracking and care, equipment scheduling, as well as others.

An example of a typical wireless network 100 is illustrated in FIG. 1. The wireless network 100 illustrated in FIG. 1 may comprise, for example, a corporate enterprise network or other LAN. With reference to this figure, the wireless network 100 includes one or more wireless access points (WAPs) 120, each of these devices coupled with a switching device 110. Switching device 110 represents any of a number of well known devices for routing packets (or cells, frames, etc.) in a network. The switching device 110 may, in turn, be coupled with another network 5 (e.g., the Internet and/or another enterprise network or LAN). One or more computing nodes 130 may establish a wireless connection 140 with one of the wireless access points 120. A node 130 may comprise any addressable computing device (e.g., a server, a desktop computer, a laptop computer, a hand-held computing device, and the like), as well as peripheral device such as a printer.

The wireless access points 120 provide access to the network 100 for a node 130 via any suitable wireless mode of communication. By way of example, a connection between a wireless access point 120 and any node 130 may be compatible with Bluetooth or with one of the wireless networking technologies defined in the IEEE 802.11 set of specifications, including 802.11a or 802.11b (as well as 802.11g). Bluetooth is a short range, low power radio technology that supports both voice and data applications, and this technology provides frequency-hopping spread spectrum (FHSS) radio connections over multiple channels in the 2.4 GHz radio band (more precisely, in the 2.4 to 2.4835 GHz band). The IEEE 802.11b standard (and 802.11g) defines wireless services over the 2.4 GHz band that spans a frequency range of 2.4 to 2.4835 GHz, whereas IEEE 802.11a defines wireless services over a number of bands in the 5 GHz frequency range, including 5.15 to 5.25 GHz, 5.25 to 5.35 GHz, and 5.725 to 5.825 GHz.

To communicate with the nodes 130, each of the wireless access points 120 includes one or more antennas. Each antenna of a wireless access point 120 is adapted to provide one or more modes of wireless communications (e.g., Bluetooth, IEEE 802.11a, IEEE 802.11b, IEEE 802.11g, or any suitable combination thereof). The antennas of a wireless access point 120 are typically adjustable, such that the direction in which the main lobe of the antenna points can be set to provide optimum performance. A wireless access point 120 may be installed in any of a variety of locations and configurations—e.g., horizontally mounted on a desk, vertically mounted on a wall or other structure, or upside-down mounted on a ceiling—and it is during installation that adjustment of the antennas is desired in order to optimize the device's performance.

Because the antennas of such a wireless access point 120 are movable, however, these antennas are also susceptible to tampering or inadvertent movement after installation. A wireless access point is commonly located in a publicly accessible place and, in addition, the antennas (e.g., "rabbit ear" antennas) of a wireless access point may extend above the device's housing (e.g., up to five inches). The antennas of a wireless access point are, therefore, easily accessible. This accessibility to the antennas exposes these antennas to accidental contact and casual tampering by people that changes their position. Such maladjustment of the antennas of a wireless access point after installation can significantly affect the device's performance, thereby degrading network services provided by the access point.

SUMMARY OF THE INVENTION

In one embodiment, a wireless networking device comprises a chassis and an antenna that is movably coupled with the chassis. The antenna is rotatable relative to the chassis. The wireless networking device also includes a locking mechanism to selectively lock and unlock a position of the antenna relative to the chassis.

In another embodiment, a wireless networking device comprises a chassis and an antenna coupled with the chassis. The antenna is movable relative to the chassis. The wireless networking device also includes a cover capable of being disposed on the chassis and separated from the chassis, as well as a locking device coupled with the antenna. The locking device, upon placement of the cover on the chassis, can engage the cover to lock the antenna at a desired position.

In a further embodiment, an apparatus comprises a chassis, a mounting post extending from the chassis, and an antenna rotationally coupled with the mounting post, the antenna being adjustable to a desired position relative to the chassis. A shroud is slidable over the antenna, and a locking element is disposed on the shroud. A cover having an opening to receive the chassis is capable of being placed on the chassis and separated from the chassis. A mating locking element is disposed on the cover. When the cover is placed on the chassis, the mating locking element on the cover engages the locking element on the shroud to lock the antenna at the desired position.

In yet another embodiment, an antenna locking device comprises a shroud having a slot slidably engagable with an antenna, wherein the antenna is movably coupled with a wireless networking device. A locking element is disposed on the shroud. The locking element is engagable with a mating locking element on the wireless networking device to lock the antenna at a desired position.

In yet a further embodiment, a cover for the chassis of a wireless networking device comprises a housing having an opening sized to receive the chassis, wherein the chassis has an antenna movably coupled therewith. A locking element is disposed on the housing, and the locking element is engagable with a mating locking element associated with the antenna. When the cover is placed on the chassis, the locking element of the housing engages the locking element associated with the antenna to lock the antenna at a desired position.

In another embodiment, a method comprises adjusting an antenna to a desired position, the antenna being movably coupled with a chassis. A locking device is placed on the antenna. A cover is than positioned on the chassis, and the cover engages the locking device to lock the antenna at the desired position.

In a further embodiment, an antenna lock comprises a housing that is positionable over an antenna, the antenna being movably coupled with a wireless networking device. A number of locking elements are disposed on the housing. At least one of the housing locking elements is engagable with at least one of a number of mating locking elements on the wireless networking device to lock the antenna at a desired position.

DETAILED DESCRIPTION OF THE INVENTION

Figure 1:
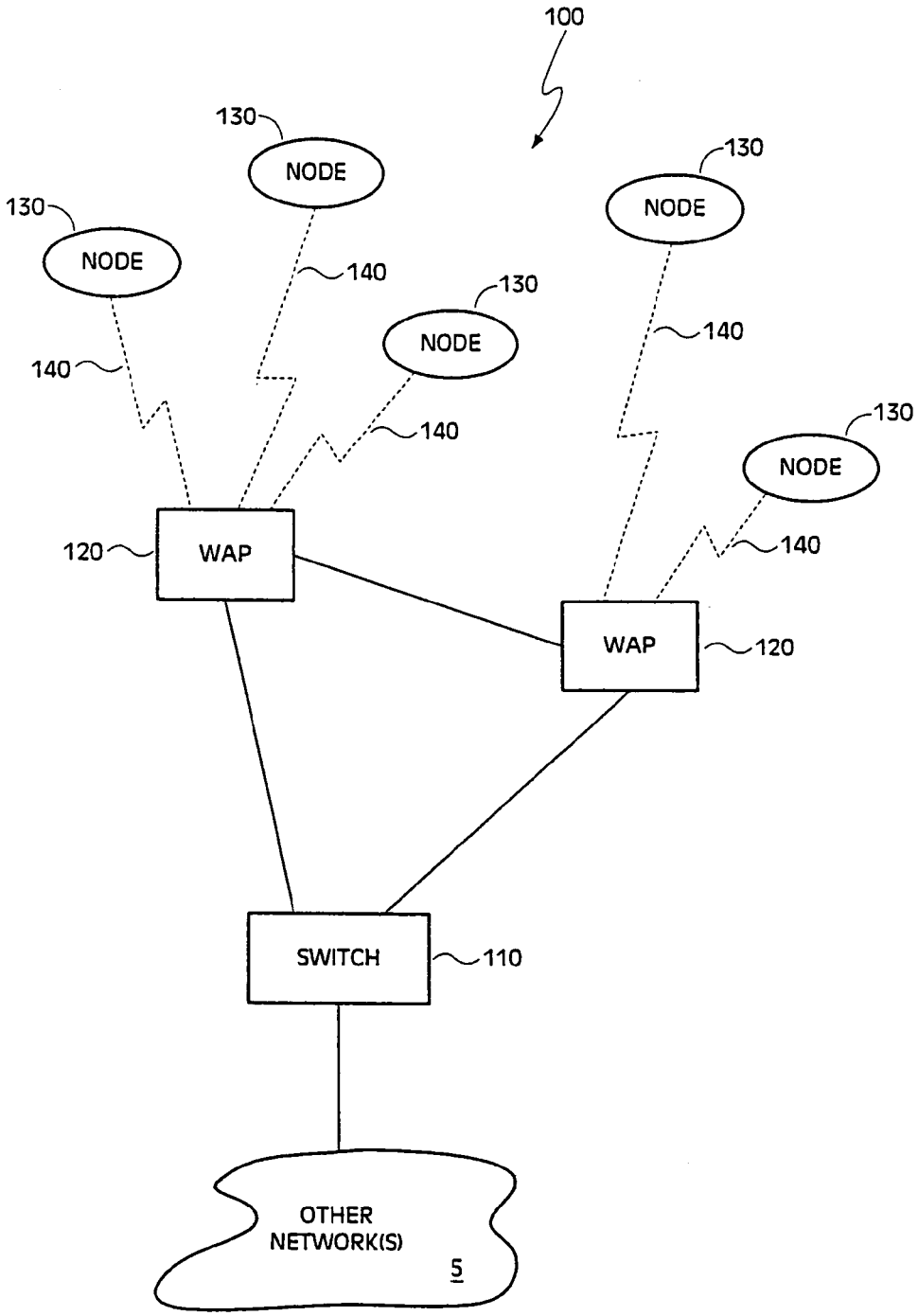
FIG. 1 (PRIOR ART)
FIG. 1 is a schematic diagram illustrating one example of a conventional wireless computer network.

Illustrated in FIGS. 2A through 2E are embodiments of a wireless access point 200 having one or more antennas, wherein the wireless access point 200 includes an antenna locking mechanism to secure each of the antennas at a desired position and/or orientation. The disclosed embodiments of the antenna locking mechanism are described below in the context of a wireless access point used for wireless networking (e.g., the wireless network 100 of FIG. 1). However, it should be understood that the disclosed antenna locking mechanisms are not limited in application to use on such a wireless access point and, further, that the disclosed antenna locking mechanisms may find application to any type of wireless networking device having an antenna.

Figure 2A:
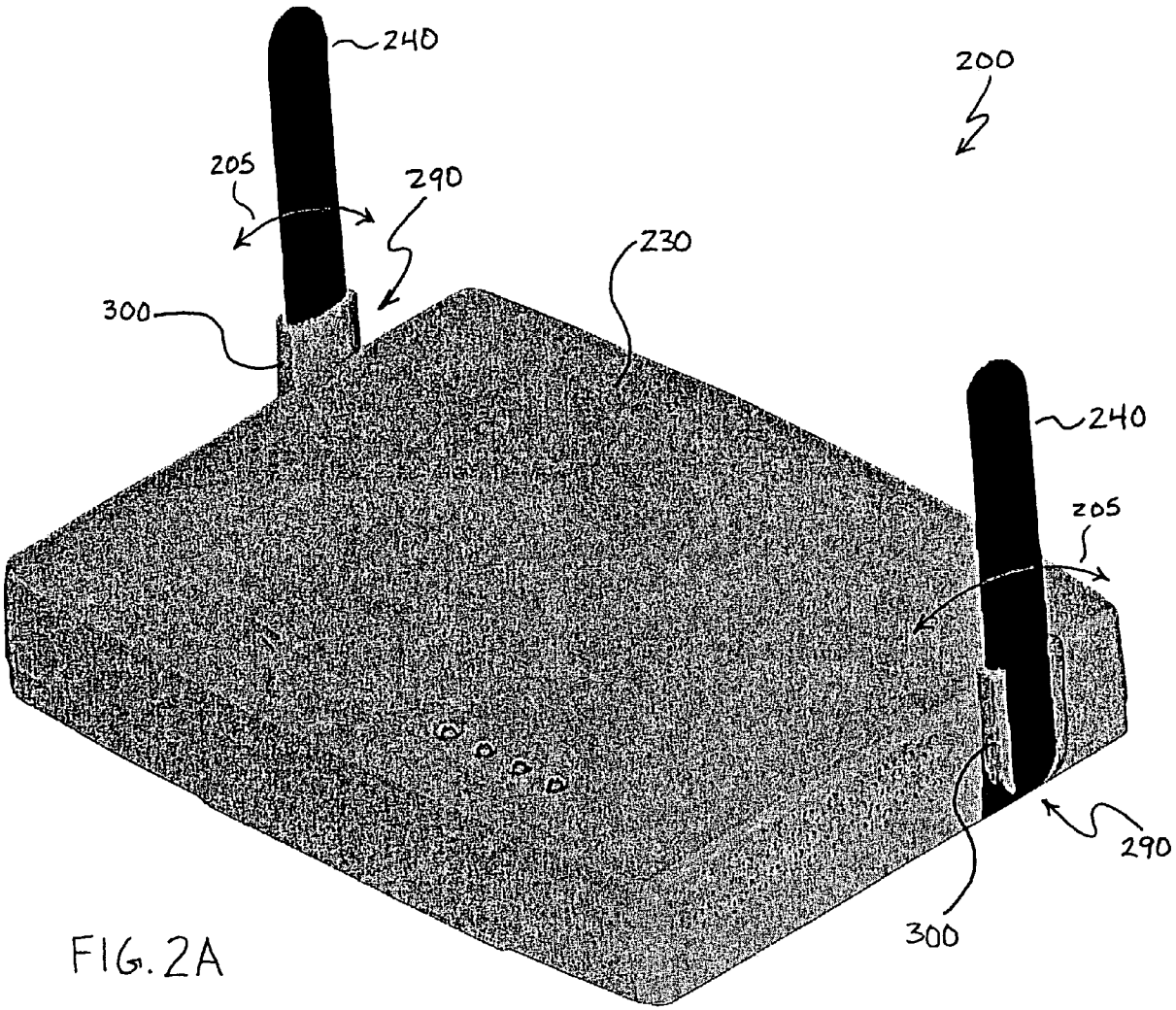
FIG. 2A is a perspective view of one embodiment of a wireless access point, this perspective view also showing an embodiment of an antenna locking mechanism.
Figure 2B:
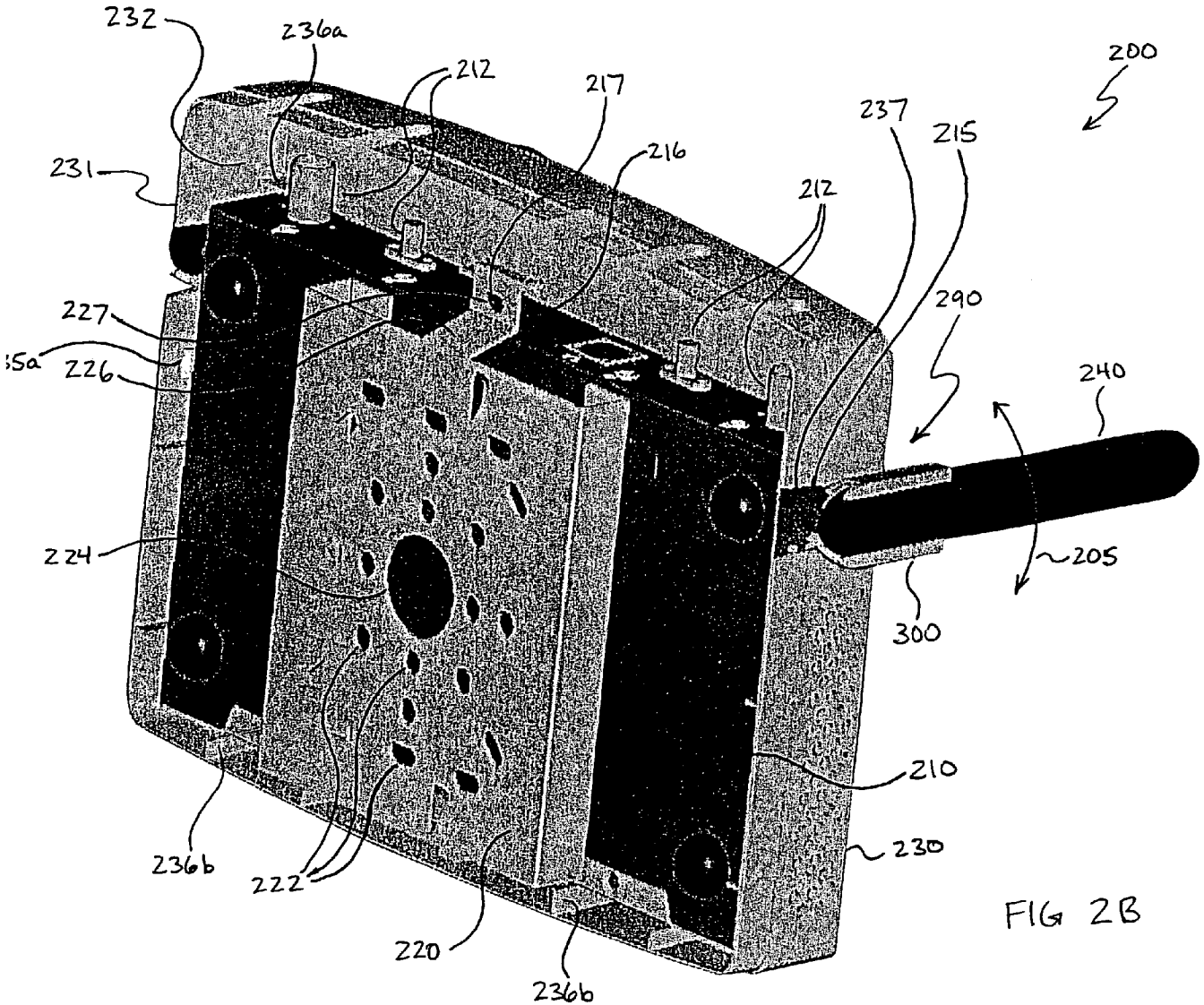
FIG. 2B is a perspective view of the underside of the wireless access point and antenna locking mechanism shown in FIG. 2A.
Figure 2C:
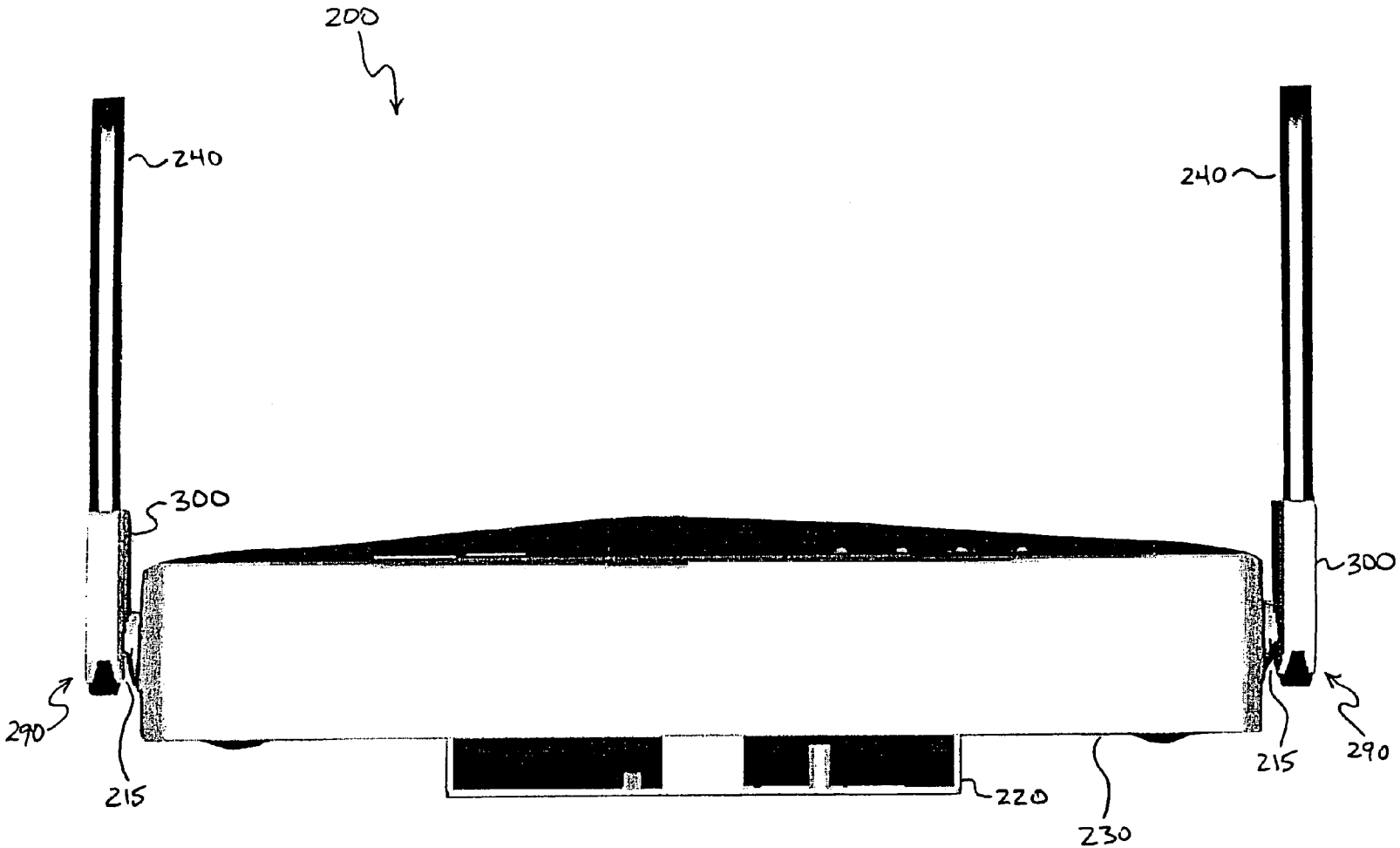
FIG. 2C is a front elevation view of the wireless access point and antenna locking mechanism shown in FIG. 2A.
Figure 2D:
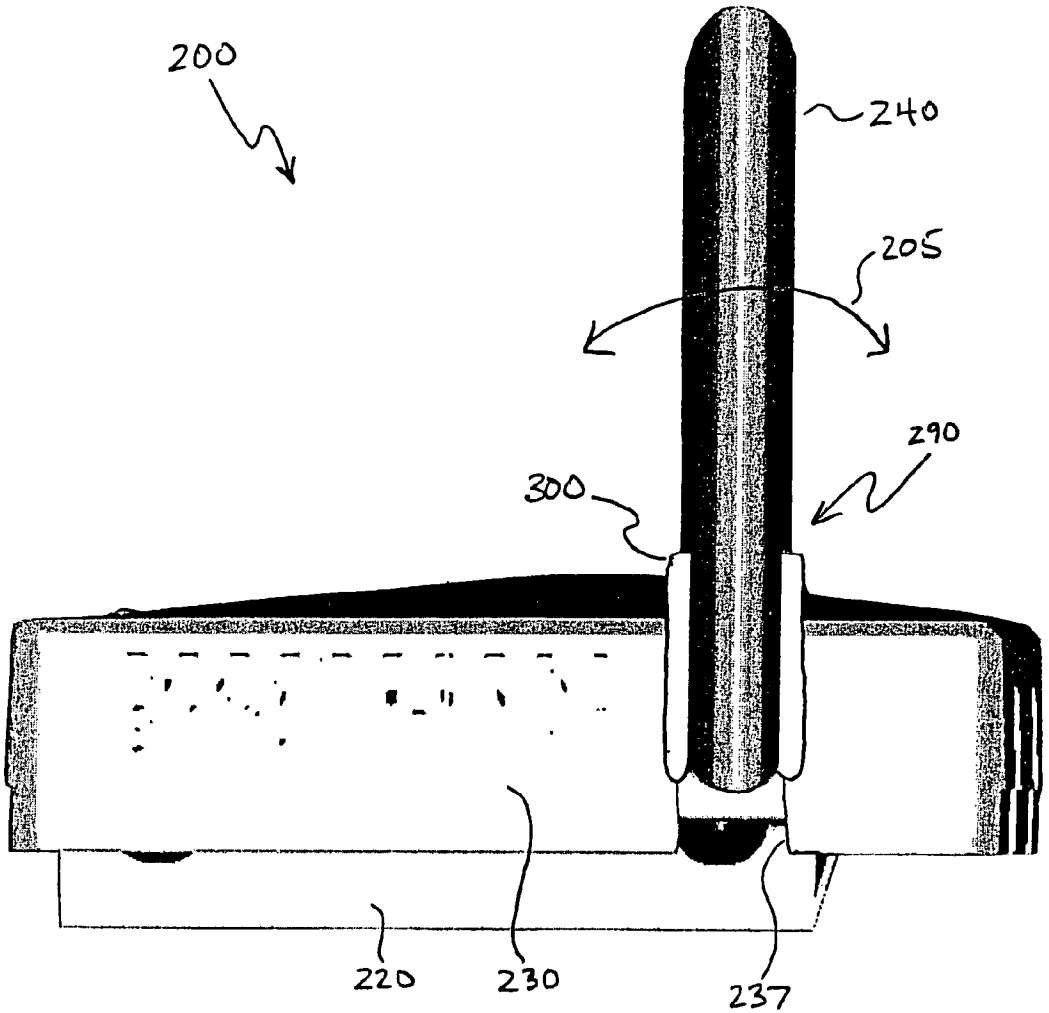
FIG. 2D is a side elevation view of the wireless access point and antenna locking mechanism shown in FIG. 2A.
Figure 2E:
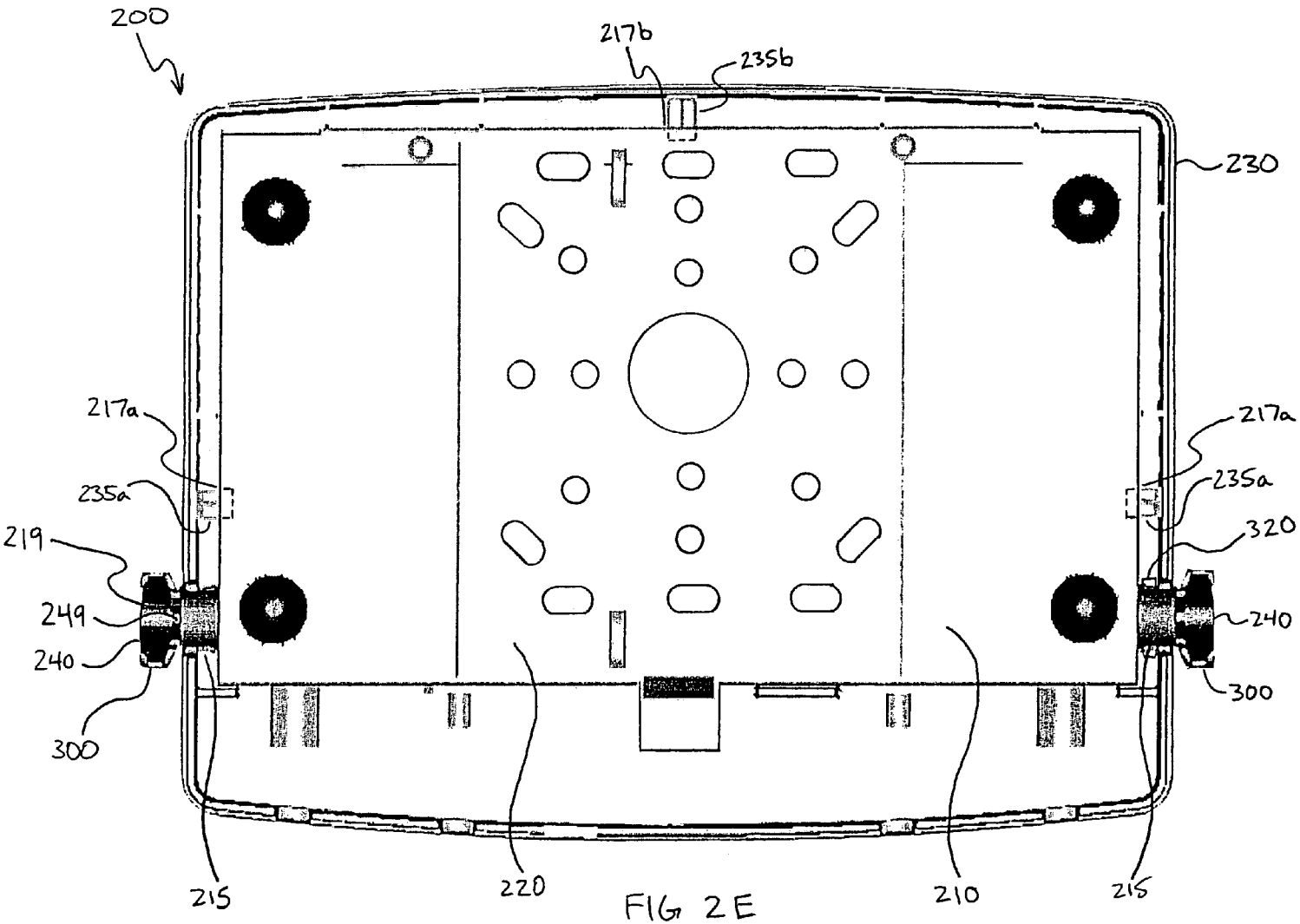
FIG. 2E is a plan view of the underside of the wireless access point and antenna locking mechanism shown in FIG. 2A.

Turning now to FIGS. 2A through 2E, various views of the wireless access point 200 are illustrated. A perspective frontal view is shown in FIG. 2A, whereas a perspective view showing the underside of the wireless access point 200 is provided in FIG. 2B. Illustrated in FIG. 2C is a front elevation view of the wireless access point 200, and FIG. 2D shows a side elevation view of this device. A plan view showing the underside of the wireless access point 200 is provided in FIG. 2E. Reference should generally be made to all figures in the following text, although the reader's attention will, at times, be drawn to specific figures.

The wireless access point 200 includes a chassis 210 comprising a generally rectangular-shaped housing having electrical components (e.g., circuit boards, integrated circuit devices, discrete electrical devices such as capacitors, wiring, etc.) disposed therein. In one embodiment, the chassis 210 functions as a wireless access point in a wireless networking environment (although, as noted above, the disclosed embodiments are not limited to such a device). The chassis 210 may include various connectors 212 enabling the wireless access point 200 to be coupled with other devices (e.g., switches, routers, etc.). The housing of chassis 210 may be constructed from any suitable material, including metals, plastics, and composite materials.

A mounting bracket 220 (best viewed in FIG. 2B) may be secured to the bottom of the chassis 210. The mounting bracket 220 includes apertures 222 of various sizes and configurations, and arranged in various patterns, to enable the chassis 210 to be securely attached to another structure (e.g., a wall, a ceiling, a table, etc.) using any suitable type and number of fasteners (e.g., screws, bolts, etc.). The bracket 220 may also include an aperture 224 for routing cables therethrough to the chassis 210. Mounting bracket 220 may be constructed from any suitable material (e.g., metals, plastics, composite materials, etc.) and secured to the chassis 210 using any suitable fastening device or method. In one embodiment, the mounting bracket 220 is removably coupled with the chassis 210 by one or more T-shaped mounting studs 229 (see FIG. 7) that slidably mate with key-shaped slot in the chassis 210. However, other devices and/or methods (e.g., threaded fasteners, rivets, spot welds, etc.) may be used to interconnect the chassis and mounting bracket 210, 220. The mounting bracket 220 may further include a flange 226 having a hole 227 that can align with a mating hole 217 of a flange 216 extending from chassis 210. A lock (e.g., a padlock) can then be inserted through the mating holes 217, 227 to secure the chassis 210 to the mounting bracket 220, thereby preventing theft of the chassis 210.

A removable cover 230 can be disposed over the chassis 210 and secured thereto. The cover 230 may have any suitable shape and configuration, so long as it can be removably coupled with the chassis 210. In one embodiment, as illustrated in FIGS. 2A–2E, the cover 230 comprises a generally rectangular shaped housing 231 having an opening 232 (see FIG. 2B) configured to receive the chassis 210. The cover 230 may be constructed from any suitable material, including metals, plastics, and composites. In one embodiment, the cover 230 is constructed using a molded plastic. Cover 230 is described in greater detail below.

Extending from the chassis 210 are one or more antenna mounting posts 215, and coupled with each of these mounting posts 215 is an antenna 240. In the embodiment of FIGS. 2A–2E, the chassis 210 includes two antenna mounting posts 215 extending from opposing sides of the chassis 210, and an antenna 240 is secured to each of the mounting posts 215. However, it should be understood that the chassis 210 may include any suitable number of mounting posts 215 and any suitable number of antennas 240 (e.g., one or more than two).

Each of the antennas 240 may comprise any type of antenna that is suited for any mode (or modes) of communication. For example, an antenna 240 may be adapted for communications using the Bluetooth™ standard (i.e., the 2.4 GHz band), the IEEE 802.11b (or 802.11g) standard (i.e., also in the 2.4 GHz band), or the IEEE 802.11a standard (i.e., the 5 GHz band). See, e.g., *Specification of the Bluetooth System: Core*, Vol. 1, Ver. 1.1, February 2001, promulgated by the Bluetooth Special Interest Group (SIG) and available at http://www.bluetooth.com. See also, e.g., IEEE Std 802.11a-1999, *Supplement to IEEE Standard for Information Technology—Telecommunications and Information Exchange Between Systems—Local and Metropolitan Area Networks—Specific Requirements—Part* 11: *Wireless LAN Medium Access Control* (*MAC*) *and Physical Layer* (*PHY*) *Specifications—High-Speed Physical Layer in the* 5 *GHz Band* (herein "IEEE 802.11a"), IEEE Std 802.11b-1999, *Supplement to IEEE Standard for Information Technology—Telecommunications and Information Exchange Between Systems—Local and Metropolitan Area Networks—Specific Requirements—Part* 11: *Wireless LAN Medium Access Control* (*MAC*) *and Physical Layer* (*PHY*) *Specifications—Higher-Speed Physical Layer Extension in the* 2.4 *GHz Band* (herein "IEEE 802.11b"), and IEEE Std. 802.11g (Draft)—2003, *Further Higher-Speed Physical Layer Extension in the* 2.4 *GHz Band*. Of course, it should be understood that an antenna 240 may be adapted for use in any other suitable communication mode, such as for use in GPRS compatible communications. See, e.g., Permanent Reference Document (PRD) IR.33, *GPRS Roaming Guidelines*, Ver. 3.1.0, April 2000, and PRD IR.40, *Guidelines for Ipv*4 *Addressing and AS Numbering for GPRS Network Infrastructure and Mobile Terminals*, Ver. 3.1.0, September 2001, both available from the GSM™ Association at http://www.gsmworld.com.

In the embodiment of FIGS. 2A–2E, the antennas 240 are movably coupled with their respective mounting post 215, and each antenna is capable of being adjusted with respect to its mounting post and the chassis (see arrows 205). For example, each mounting post 215 may comprise a hollow tubular structure having an inner diameter 219 adapted to slidably receive a cylindrical shaft 249 extending from one of the antennas 240 (see FIG. 2E), wherein an antenna 240 can rotate relative to its mounting post 215. However, it should be understood that the use of mounting posts 215 providing for rotational movement of the antennas 240 is but one example of the manner in which an antenna 240 could be coupled with the chassis 210 and, further, that any suitable device and/or method may be employed to couple an antenna 240 to the chassis 210. For example, an antenna may be coupled with the chassis using a spherical ball-joint providing for multiple degrees of freedom of movement for the antenna. Thus, as used herein, the terms "rotation", "rotational", "rotatable", and the like should not be limited in meaning to rotation in a single plane, although these terms may encompass such motion. Rather, each of these terms should be construed to encompass rotation or movement in one plane, as well as rotation or movement in multiple planes (e.g., as may be provided by a spherical ball joint).

Enabling relative movement—rotational or otherwise—of the antennas 240 with respect to chassis 210 allows for adjustment of the antennas 240 after installation of the wireless access point 200, such that the direction of the antenna's main lobe—and, hence, the performance of the antenna 240 and wireless access point 200—can be optimized. However, as suggested above, allowing for adjustment of the antennas 240 also exposes the antennas to human tampering and inadvertent contact after installation, which can decrease performance and negatively impact operation of the wireless access point 200. To prevent such post-installation tampering and movement of the antennas 240, the wireless access point 200 includes one or more antenna locking mechanisms 290. In one embodiment, an antenna locking mechanism 290 comprises any device that enables an antenna 240 to be selectively locked at a desired position and unlocked for movement. Thus, the antenna locking mechanisms 290 enable the antennas 240, once adjusted to a desired position for operation, to be locked at this position. Other embodiments of the antenna locking mechanism 290 are described in more detail below.

In one embodiment, as illustrated in FIGS. 2A–2E, a locking mechanism 290 comprises a locking device 300 coupled with an antenna 240 that, in conjunction with the cover 230, locks the antenna at a desired position. More specifically, as the cover 230 is placed on and secured to the chassis 210, the cover 230 engages the locking device 300 to lock the antenna 240 at the desired position. To adjust or otherwise move the antenna 240, the cover 230 is removed from the chassis 210, which disengages the cover 230 from the locking device 300 and frees the locking device 300 and antenna 240, thereby allowing for movement of the antenna 240. Thus, for the embodiment of FIGS. 2A–2E, the locking mechanism 290 can selectively lock and unlock the antenna 240 (and locking device 300) by installation and removal, respectively, of the cover 230. Embodiments of the locking device 300 are described below.

Figure 3A:
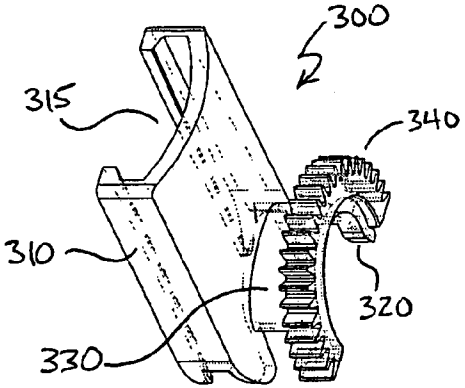
FIG. 3A is a perspective view of one embodiment of an antenna locking device.
Figure 3C:
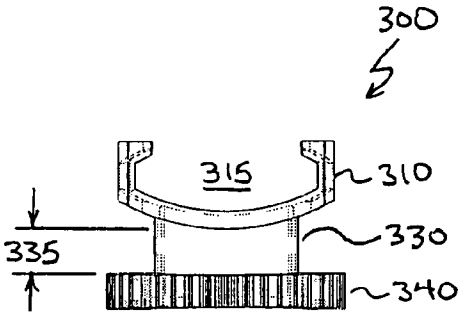
FIG. 3C is a top plan view of the antenna locking device illustrated in FIG. 3A.
Figure 3E:
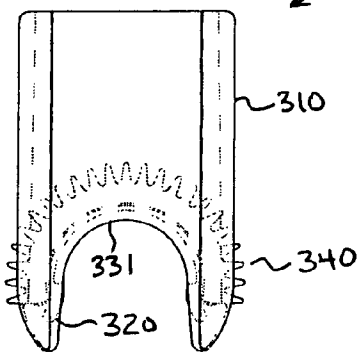
FIG. 3E is a rear elevation view of the antenna locking device illustrated in FIG. 3A.
Figure 3D:
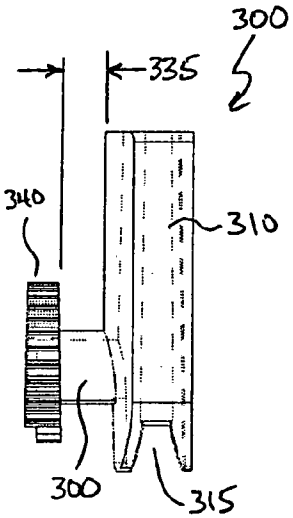
FIG. 3D is a side elevation view of the antenna locking device illustrated in FIG. 3A.
Figure 3B:
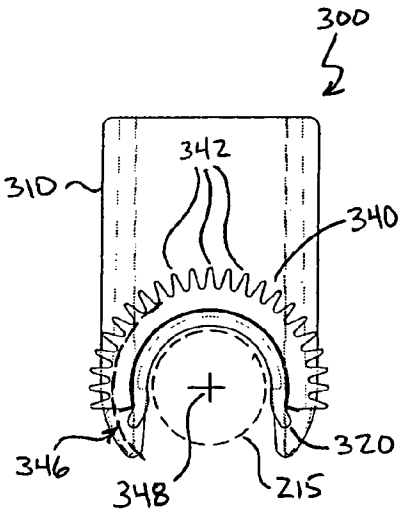
FIG. 3B is a front elevation view of the antenna locking device illustrated in FIG. 3A.
Figure 4:
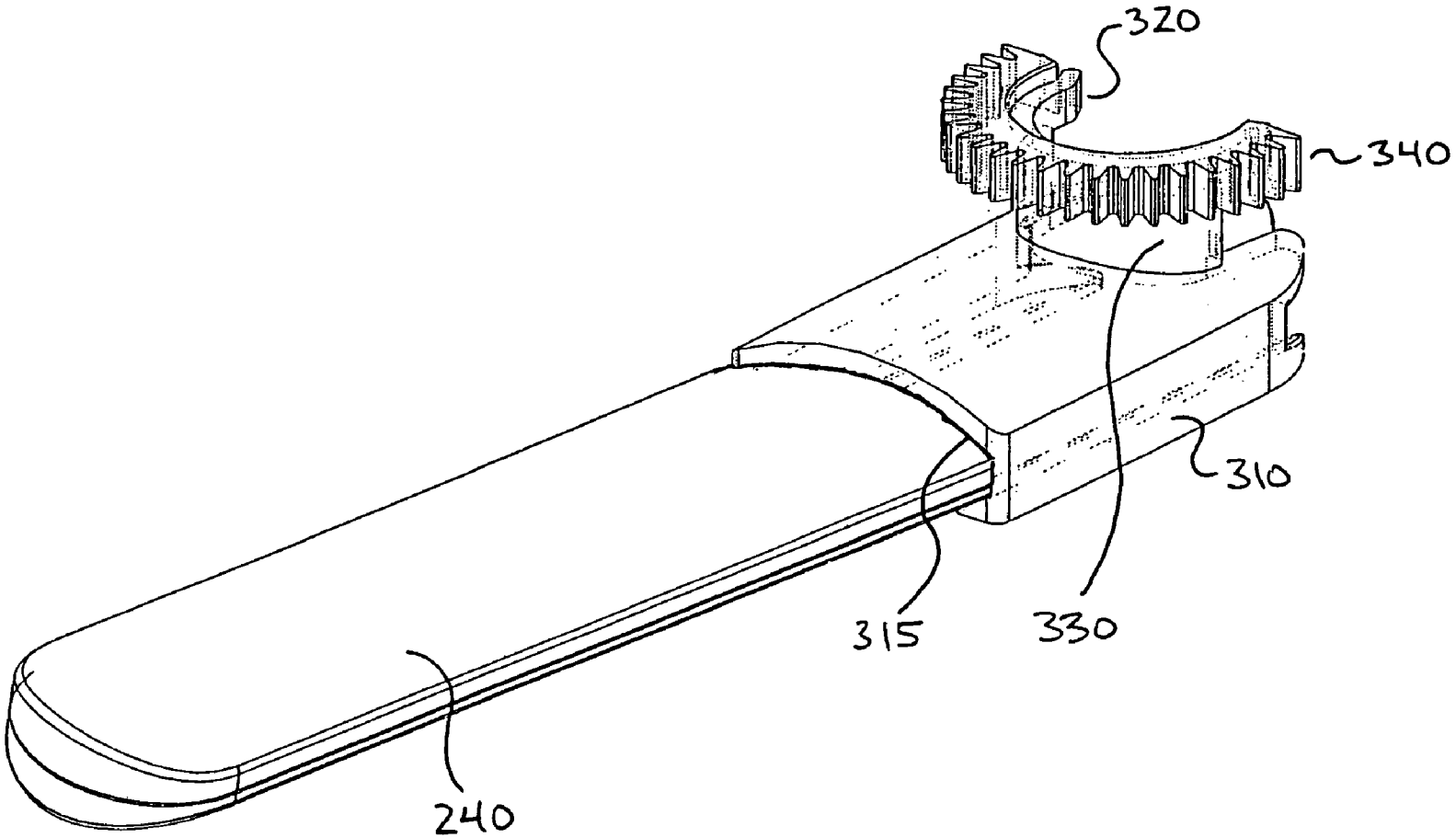
FIG. 4 is a perspective view of the antenna locking device of FIGS. 3A–3E in combination with an antenna.

Referring now to FIGS. 3A through 3E and FIG. 4, an embodiment of the locking device 300 is illustrated in greater detail. The locking device 300 comprises a shroud 310 having an opening or slot 315. The slot 315 is sized to slidably receive the antenna 240, such that the shroud can be installed on the antenna by sliding the shroud over the antenna. This is illustrated in FIG. 4, as well as FIGS. 2A–2E, where the locking device 300 is shown installed over one of the antennas 240. To secure the locking device 300 in place, a clip 320 may be disposed on the shroud 310. In the embodiment of FIGS. 3A–3E, the clip 320 is disposed on a member 330 extending from the shroud 310. The clip 320 comprises a resilient, flexible member designed to slip over and snap onto one of the mounting posts 215 in order to secure the locking device 300 in place with respect to the antenna 240 and chassis 210. This is illustrated in FIG. 3B (mounting post 215 shown in dashed line), as well as in FIG. 2E, where the clip 320 of each locking device 300 is shown disposed over a mounting post 215. In another embodiment, the locking device 300 does not include a clip 320, and a lower surface 331 of member 330 (see FIG. 3E) simply abuts (and slides over) the mating mounting post 215.

Disposed on the shroud 310 is a locking element 340. The cover 230 includes a mating locking element that, upon installation of the cover 230 over chassis 210, can engage the locking element 340 on locking device 300, thereby fixing the position of the locking device 300 and the antenna 240 captured within the device's shroud 310. In one embodiment, as shown in FIGS. 3A–3E, the locking element 340 comprises a number of locking teeth 342 (e.g., gear teeth) disposed on the member 330 extending from shroud 310, and the mating locking element on the cover 230 comprises a number of mating teeth. The locking teeth 342 are disposed on the circumference of a circle 346 (see FIG. 3B) having a center 348 coincident with a center of the mounting post 215 (when placed on the mounting post). In one embodiment, as shown in the figures, the locking teeth 342 extend over approximately 180 degrees of the circle 346. However, it should be understood that the locking device 300 may include any suitable number of locking teeth 342 that extend over any suitable portion of the circumference of circle 346.

Figure 5A:
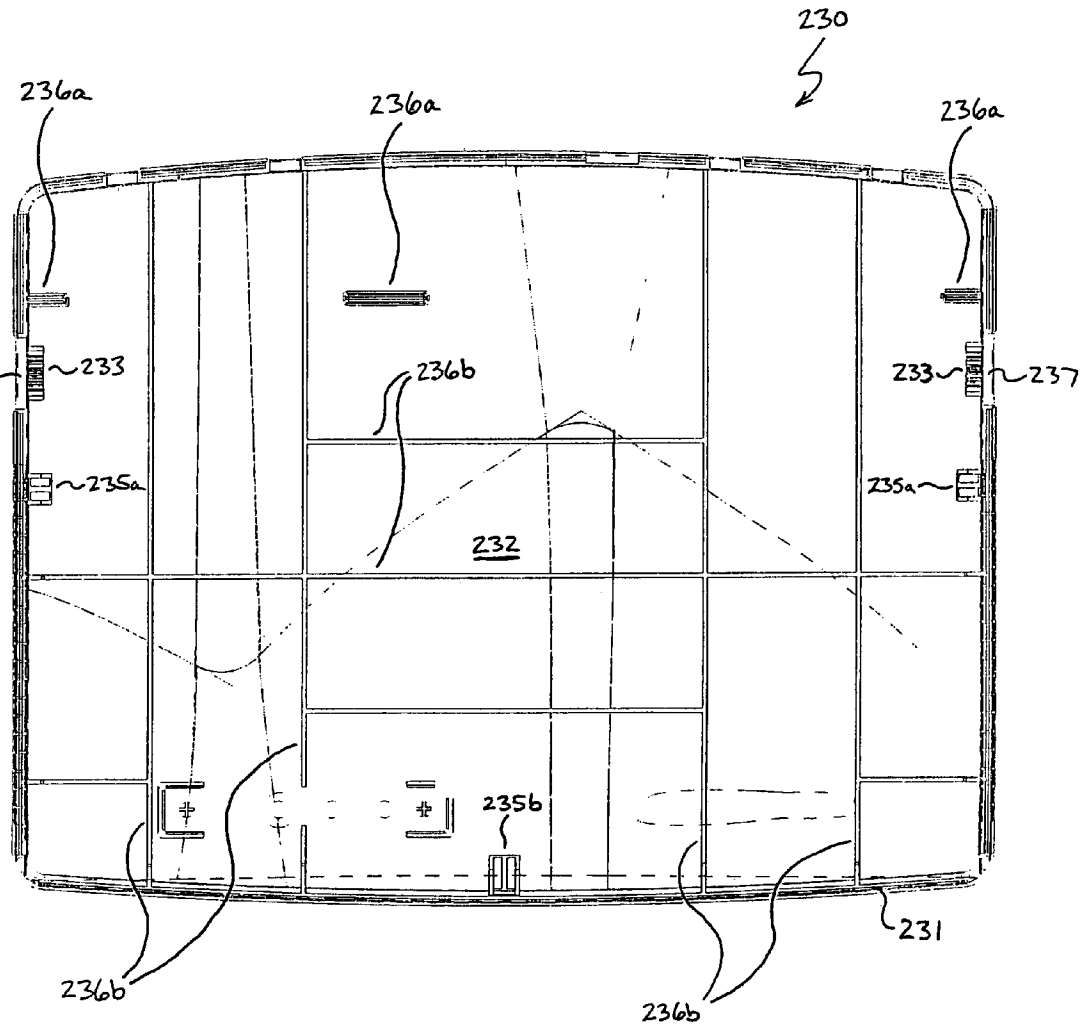
FIG. 5A is a plan view of the underside of an embodiment of a cover for the wireless access point shown in FIGS. 2A–2E.
Figure 5B:
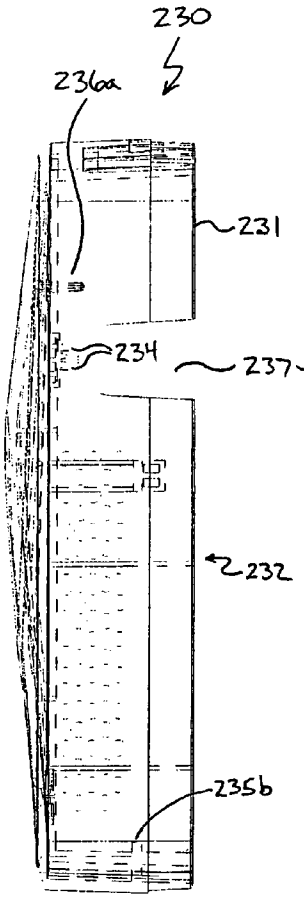
FIG. 5B is a side elevation view of the cover shown in FIG. 5A.

Referring now to FIG. 5, the cover 230 is described in more detail. Illustrated in FIG. 5A is a plan view of the cover 230, as viewed from the underside, and FIG. 5B shows a side elevation view of the cover. As noted above, in the embodiment of FIGS. 2A–2E, the cover 230 comprises a generally rectangular shaped housing 231 having an opening 232 sized and configured to receive the chassis 210. Also, as previously noted, the cover 230 may be constructed from any suitable material (e.g., metals, plastics, composites, etc.) and, in one embodiment, the cover comprises a molded plastic. In the embodiment of FIGS. 2A–2E and 5A–5B, the cover 230 is fully separable from the chassis 210—i.e., the cover 230 can be lifted off and separated from chassis 210—and the cover is secured to the chassis by a number of retaining and registration elements, as will be described below. In other embodiments, however, the cover 230 may be rotationally coupled with the chassis 210 by a rotational joint (e.g., a hinge).

As set forth above, in one embodiment, the cover 230 includes one or more mating locking elements that, upon placement of the cover 230 on chassis 210, engage the locking elements 340 on locking devices 300. This is shown in FIGS. 5A and 5B, where the cover 230 includes mating locking elements 233 disposed on the housing 231, wherein one mating locking element 233 is disposed on each of opposing sides of the housing 231 (for locking antennas 240 disposed on each of opposing sides of the chassis 210, as shown in FIGS. 2A–2E). In the embodiment of FIGS. 5A–5B (and FIGS. 2A–2E), each mating locking element 233 comprises a number of mating locking teeth 234 (e.g., gear teeth). The mating teeth 234 of mating locking element 233 on cover 230 are sized and configured to mesh (upon closure of the cover 230 on chassis 210) with at least a portion of the number of locking teeth 342 disposed on a locking element 300.

Generally, the number of mating locking teeth 234 on cover 230 should be the maximum number of teeth allowable without creating interference that is sufficiently severe to prohibit meshing between the mating teeth 234 of cover 230 and the locking teeth 342 of locking device 300. The appropriate number of mating teeth 234 will, at least in part, be a function of such factors as tooth size, geometry, and orientation, and those of ordinary skill in the art will appreciate that the optimum number of mating teeth 234 on cover 230 will vary with design. In one embodiment, the number of mating locking teeth 234 comprises four teeth, as shown in FIG. 5B. However, in other embodiments, the number of mating teeth 234 on cover 230 varies between 1 and 8.

As suggested above, it is engagement between the locking teeth 342 of locking device 300 and the mating locking teeth 234 on cover 230 that, upon placement of the cover 230 on chassis 210, lock the antennas 240 into position. Accordingly, in one embodiment, it is desirable to snugly secure the cover 230 onto the chassis 210, thereby minimizing relative movement between these component that could potentially lead to disengagement of the locking teeth 342 and mating locking teeth 234 of the locking device 300 and cover 230, respectively. Thus, in one embodiment, the cover 230 includes one or more retaining features that secure the cover 230 onto the chassis 210. In a further embodiment, the cover 230 includes one or more registration features designed to align the cover 230 relative to chassis 210 and/or to inhibit relative movement between these two components.

A retaining element comprises any feature or structure capable of removably securing the cover 230 to the chassis 210. For example, as shown in FIGS. 5A and 5B (and FIGS. 2B and 2E), the cover 230 may include retaining elements 235*a*. Each of the retaining elements 235*a* comprises a projection or other structure extending away from the housing wall of cover 230 that is size and oriented to mate with an apertures 217*a* (see FIG. 2E and FIG. 7) in opposing sides of the housing wall of chassis 210. In one embodiment, each retaining element 235*a* comprises a resilient tab or other resilient projection that is sized and oriented to mate with and snap into the aperture 217*a*. By way of further example, as shown in FIGS. 5A and 5B, the cover 230 may include another retaining element 235*b*. The retaining element 235*b* may also comprise a resilient projection or other structure extending from an interior frontal wall of the housing 231 of cover 230, and this retaining element 235*b* is sized and oriented to mate with an aperture 217*b* (see FIG. 2E) on the front wall of the chassis housing. When the cover 230 is positioned on chassis 210, the two opposing retaining elements 235*a* and the retaining element 235*b* function together to secure the cover 230 at three different points on the chassis 210. It should be understood that a retaining element may comprise any other suitable fastener or connector (e.g., screws, bolts, pins, etc.).

A registration element comprises any feature or structure capable of aligning the cover 230 with chassis 210 during positioning of the cover on the chassis and/or that is capable of preventing relative movement between the cover 230 and chassis 210 when the cover is installed on the chassis. For example, as shown in FIGS. 5A and 5B (see also FIG. 2B), the cover 230 may include a number of registration features 236*a*. Each of the registration elements 236*a* comprises a projection extending from the interior wall of the cover 230 that is located and orientated to engage or abut a surface of the chassis exterior upon placement of the cover 230 over the chassis 210. Contact between the registration elements 236*a* and the chassis 210 inhibits movement of the cover 230 relative to the chassis 210. The cover 230 may also include a number of registration elements 236*b* (see FIGS. 5A, 5B, and 2B). Each of the registration elements 236*b* comprises a rib extending over the interior surface of the cover 230, wherein at least a portion of a rib may abut the exterior of the chassis 210 to inhibit movement of the cover 230 relative to chassis 210. Note that the ribs 236*b* also provide structural rigidity for the housing 231 of cover 230, and it should be understood that not all of the ribs 236*b* may be used for registration purposes.

The cover 230 also includes slots 237 on opposing side thereof. Each slot is sized and oriented to allow the cover 230 to slid over its mating mounting post 215 and locking device 300. In one embodiment, the slots 237 are dimensioned such that they clear the mounting posts 215 and locking devices 300 and simply allow the cover 230 to fit over these components. However, in another embodiment, each slot 237 is dimensioned to slide over the member 330 extending from a locking device 300 and, further, the thickness of the cover housing 231 is sized to be received in a gap 335 (see FIGS. 3A–3E) formed between the shroud 310 and locking element 340 of the locking device 300. In yet a further embodiment, the cover 230 may includes resilient clips (similar to clips 320 on locking devices 300) to slide over and snap onto the member 330 extending from the shroud 310. Thus, the slots 237 can also function as registration elements and/or as retaining elements (e.g., with clips). It should be understood that a registration element may comprise any other suitable structure or mechanism, such as a pin, a threaded fastener (e.g., screws, bolts, and the like), etc.

Any suitable number, type, and combination of retaining elements and registrations elements may be incorporated onto the cover 230 (and/or the chassis 210). A retaining element or a registration element may, in one embodiment, form an integral part of the housing 231 of cover 230—e.g., where the cover 230 is formed as a single part from molded plastic—however, it should be understood that a retaining or a registration element may comprise a separate part that is attached to the cover 230. Further, those of ordinary skill in the art will appreciate that a given structural feature may perform both a retaining function and a registration function and, therefore, may act as both a retaining element and a registration element (e.g., retaining elements 235*a* will also position the cover 230 relative to chassis 210, as well as securing the cover 230 thereto).

Figure 6:
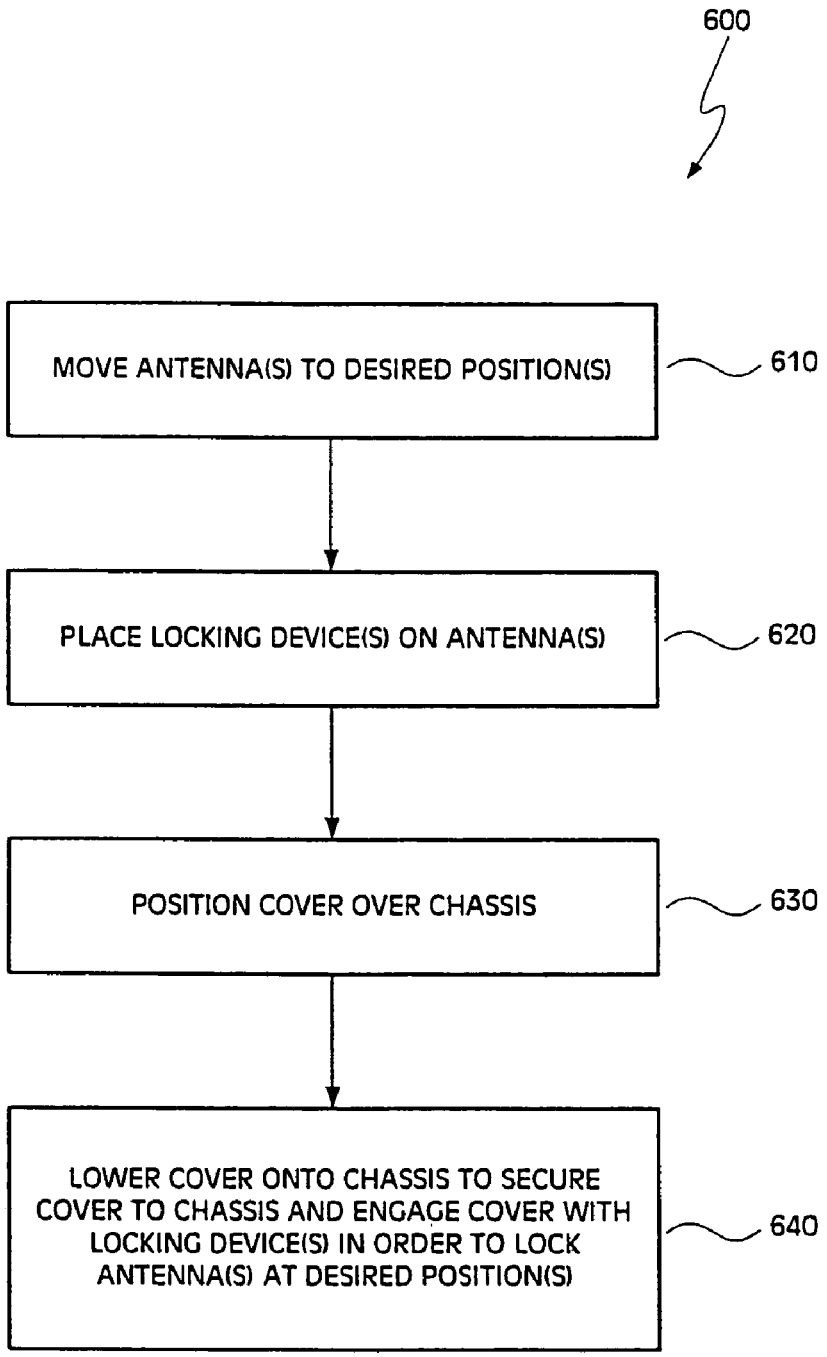
FIG. 6 is a block diagram illustrating an embodiment of a method of locking an antenna at a desired position.

The operation and function of the above-described embodiments of locking device 300 in conjunction with wireless access point 200 may be better understood with reference to FIG. 6, which shows a block diagram illustrating an embodiment of a method 600 of locking an antenna at a desired position. Referring to block 610 in this figure, each antenna 240 is moved to a desired position (e.g., a position that directs the main lobe of the antenna in an optimum direction). As set forth at block 620, a locking device 300 is then placed on each of the antennas 300. For the embodiment of locking device 300 described above, the shroud 310 is slid over the antenna 240 until the clip 320 engages the mounting post 215. Note that, even when clip 320 of locking device 300 has been snapped onto the mounting post 215, the locking device 300—and the antenna 240 captured by this locking device—may still rotate relative to the mounting post 215. Thus, positioning of antenna 240 may be performed while the locking device 300 is installed on the antenna (i.e., the ordering of blocks 610 and 620 may be reversed).

Referring now to block 630, the cover 230 is positioned over the chassis 210 and, as set forth at block 640, the cover is lowered onto the chassis. As the cover 230 is disposed onto the chassis 210, the locking element 340 (e.g., locking teeth 342) of each locking device 300 engages a mating locking element 233 (e.g., mating locking teeth 234) on the cover 230. The engagement between the locking elements 340, 233 of the locking device 300 and cover 230, respectively, fixes the position of the locking device 300 and, accordingly, also fixes the position of the antenna 240 with which the locking device is coupled. Also, as the cover 230 is placed on the chassis 210, the retaining elements and registration elements on the cover 230 (and/or chassis 210) function to both secure the cover to the chassis and prevent relative movement between these two components.

Figure 7:
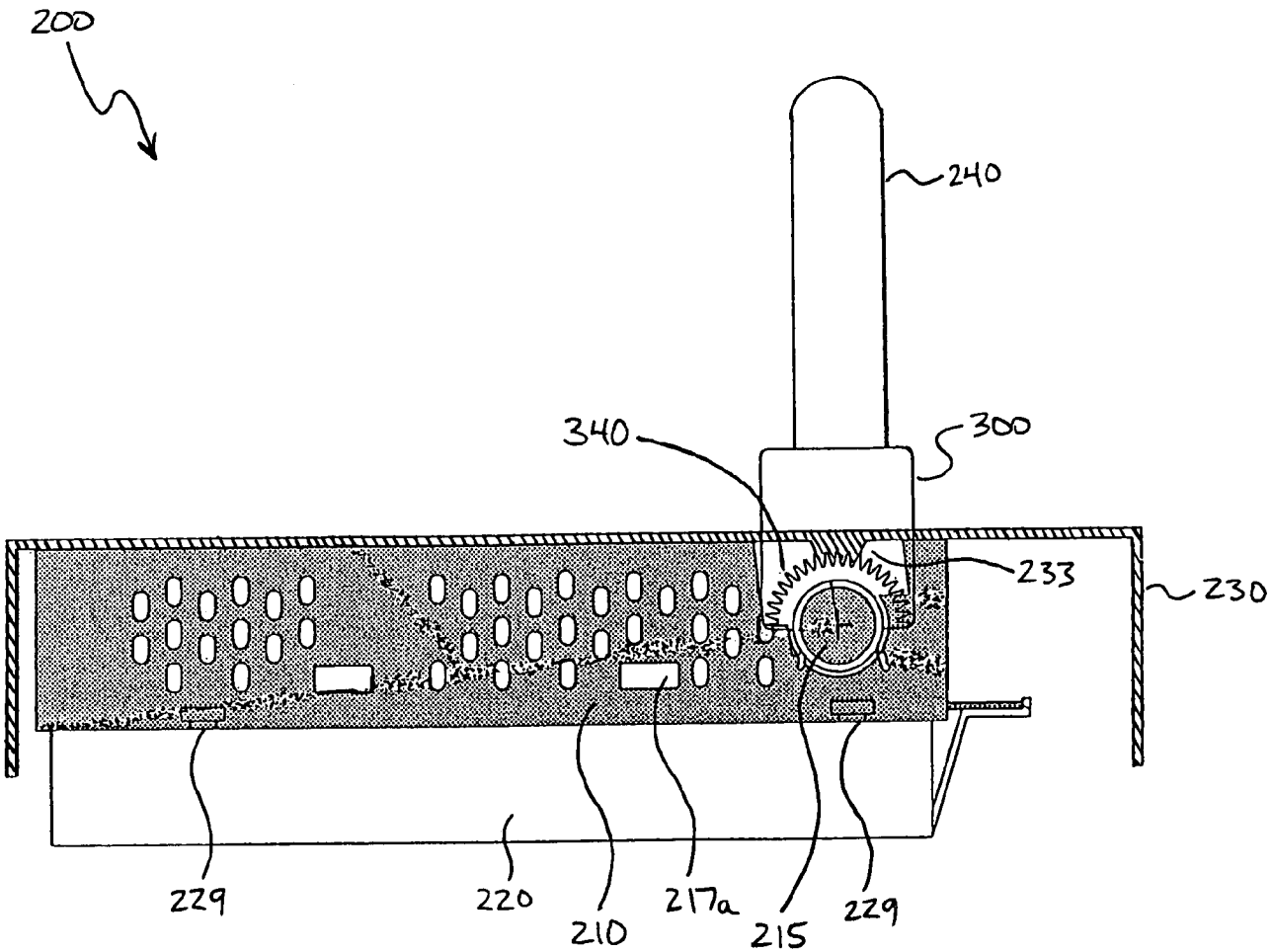
FIG. 7 is a cross-sectional view of the wireless access point of FIGS. 2A–2E, the locking device of FIGS. 3A–3E, and the cover of FIGS. 5A–5B, which view further illustrates the method of FIG. 6.

The method 600 of FIG. 6 is further illustrated in FIG. 7, which shows a side elevation view of the wireless access point 200, wherein the cover 230 is shown in cross-section (chassis 210 and mounting bracket 220 not shown in cross-section). With reference to this figure, the locking device 300 has been slid onto the antenna 240 and the clip 320 engaged with the mounting post 215. The antenna 240 has been rotated to a desired position (either with or without the locking device 300 installed), and the cover 230 secured to the chassis 210 to fix the antenna 240 at the desired position. In the example of FIG. 7, the antenna 240 has been placed in a substantially vertical position; however, it should be understood that the antenna may be placed in any desired position relative to chassis 210. In one embodiment, where the locking elements of the locking device 300 and cover 230 comprise locking teeth, the possible positions of the antenna 240 may correspond to a number of discrete angular positions that are a function of the number of locking teeth. In other words, the locking teeth 342 on locking device 300 will mesh with the mating locking teeth 234 on cover 230, and the possible positions of the antenna correspond to angular positions at which the locking teeth 342, 234 can mesh. For example, for the embodiment of FIGS. 3A–3E, the locking element 340 comprises 23 locking teeth that span an arc of approximately 207 degrees, wherein 20 of these 23 locking teeth span an arc of approximately 180 degrees (the additional teeth outside of an 180 degree arc may be provided to insure that multiple teeth are engaged at the extreme angular positions of 0 and 180 degrees). Thus, the angular resolution of the locking device 300 and antenna 240 is approximately 9 degrees (i.e., there is a potential position for the antenna approximately every 9 degrees).

One embodiment of a locking mechanism 290 for wireless access point 200 has been described above. The disclosed locking mechanism included a locking device 300 that fixed the position of an antenna 240 in conjunction with the cover 230. However, it should be understood that the locking mechanism 290 for wireless access point 200 is not limited to such a structure and, further, that any suitable device and/or method may be used to lock the antennas 240 at a desired position. Alternative embodiments of the locking mechanism 290 are now described.

Figure 8A:
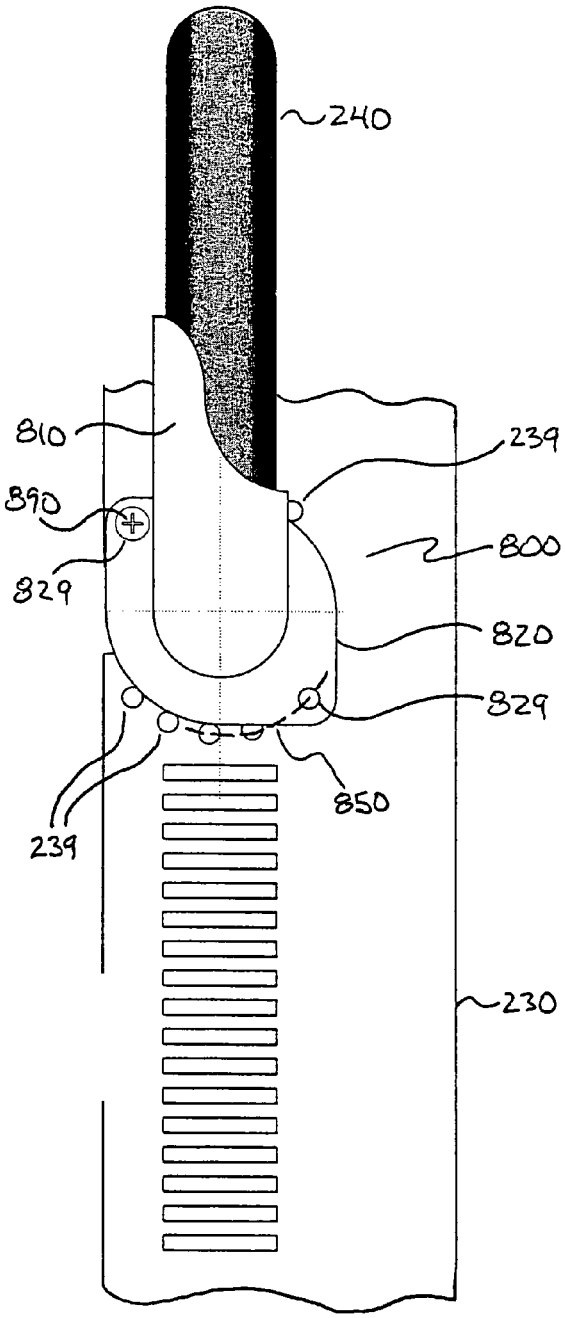
FIGS. 8A–8C illustrate another embodiment of an antenna locking device.
Figure 8B:
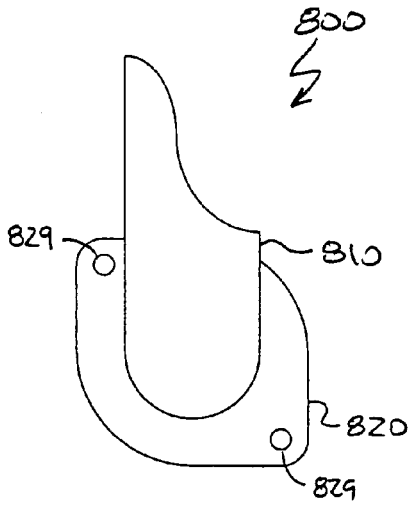
Figure 8C:
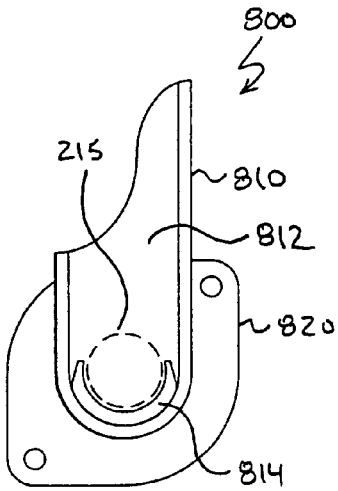

Referring to FIGS. 8A through 8C, illustrated is another embodiment of a locking device 800, and this locking device may be used as the locking mechanism 290 on wireless access point 200. An assembly view of the locking device 800 (as assembled on cover 230) is shown in FIG. 8A, whereas front and rear elevation views of the locking device are shown in FIGS. 8B and 8C, respectively.

The locking device 800 includes a housing 810 having an interior cavity 812 that is sized and configured to fit over an antenna 240, such that the interior cavity, when installed on the antenna 240, will capture the antenna therein and prevent (or at least minimize) relative movement between the antenna 240 and locking device 800. In one embodiment, a resilient clip 814 is disposed in the interior cavity 812, wherein the clip is sized to fit over and snap onto a mounting post 215, such that the locking device 800 can be secured to the mounting post 215 (while still allowing movement of the antenna 240 captured in the interior cavity 812 of housing 810).

The locking device 800 also includes a flange 820 coupled with the housing 810. In one embodiment, the flange 820 and housing 810 comprise a single, integrated part, which may be constructed from, for example, molded plastic. The flange 820 includes one or more locking holes 829. The cover 230 (or, in another embodiment, the chassis 210) includes a number of mating locking holes 239. The mating locking holes 239 on cover 230 (or chassis 210) are substantially the same size and shape as the locking holes 829 on flange 820, and the locking holes 239, 829 are arranged on arcs 850 of substantially equal radius.

To lock the antenna 240 at a desired position using the locking device 800, the housing 810 is positioned over the antenna, and the clip 814 secured to the mounting post 215. The antenna 240 is rotated (either with or without the locking device 800 disposed thereon) to a desired position. Note that the possible positions of antenna 240 are those discrete positions corresponding to angles at which the locking holes 239, 829 align. Once a desired position has been achieved, and the housing 810 positioned over the antenna 240, a fastener (or fasteners) 890—e.g., a screw, bolt, retaining pin, etc.—is inserted through the mating locking hole (or holes) 239, 829 and secured in place. With one or more sets of mating locking holes 239, 829 fixed relative to one another, the position of the antenna 240 relative to the cover 230 (and chassis 210) is locked in place. Note also that the fastener (or fasteners) 890, along with clip 814, will secure the locking device 800 to the cover 230 (or chassis 210).

Figure 9A:
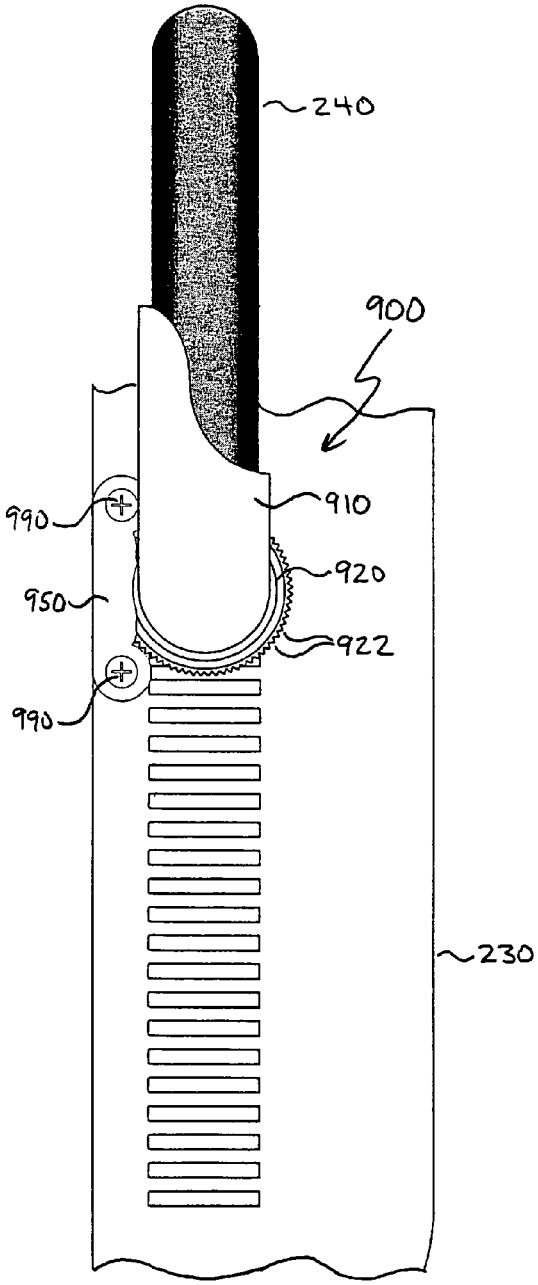
FIGS. 9A–9D illustrate a further embodiment of an antenna locking device.
Figure 9B:
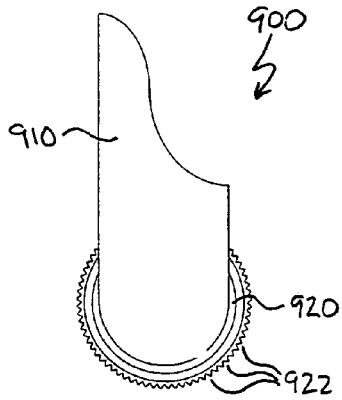
Figure 9C:
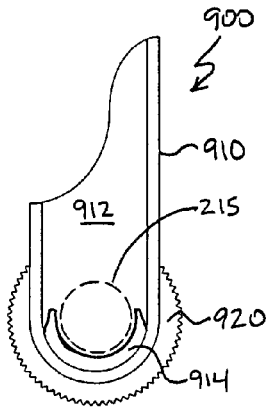
Figure 9D:
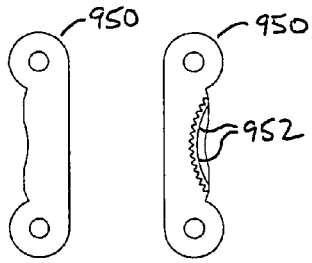

Turning now to FIGS. 9A through 9D, illustrated is a further embodiment of a locking device 900, and this locking device may also be used as the locking mechanism 290 on wireless access point 200. An assembly view of the locking device 900 (as assembled on cover 230) is shown in FIG. 9A, whereas front and rear elevation views of the locking device are shown in FIGS. 9B and 9C, respectively. Front and back views of a lock plate are shown in FIG. 9D.

The locking device 900 includes a housing 910 having an interior cavity 912 that is sized and configured to fit over an antenna 240, such that the interior cavity, when installed on the antenna 240, will capture the antenna therein and prevent (or at least minimize) relative movement between the antenna 240 and locking device 900. In one embodiment, a resilient clip 914 is disposed in the interior cavity 912, wherein the clip is sized to fit over and snap onto a mounting post 215, such that the locking device 900 can be secured to the mounting post 215 (while still allowing movement of the antenna 240 captured in the interior cavity 912 of housing 910).

The locking device 900 also includes a flange 920 coupled with the housing 910. In one embodiment, the flange 920 and housing 910 comprise a single, integrated part, which may be constructed from, for example, molded plastic. The flange 920 includes a number of locking teeth 922. Any suitable number of locking teeth 922 may be employed and, in the embodiment of FIGS. 9A–9D, the locking teeth are distributed over a full 360 degree arc. Disposed on a lock plate 950 are a number of mating locking teeth 952 (see FIG. 9D). The mating locking teeth 952 on lock plate 950 are of a size and configuration such that they can mesh with the locking teeth 922 on flange 920. The lock plate 950 may include any suitable number of locking teeth 952 (e.g., up to 15, as shown in FIG. 9D), so long as there is sufficient engagement between these locking teeth and the locking teeth 922 on flange 922, as will be explained below.

To lock the antenna 240 at a desired position using the locking device 900, the housing 910 is positioned over the antenna, and the clip 914 secured to the mounting post 215. The antenna 240 is rotated (either with or without the locking device 900 disposed thereon) to a desired position. Note that the possible positions of antenna 240 are those discrete positions corresponding to angles at which the locking teeth 922, 952 will mesh. Once a desired position has been achieved, and the housing 910 positioned over the antenna 240, the lock plate 950 is positioned over the flange 920 and secured to the cover 230 (or chassis 210) using one or more fasteners 990 (e.g., screws, bolts, retaining pins, etc.). When the lock plate 950 is positioned over the flange 922, at least some of the locking teeth 952 on lock plate 950 will mesh with at least a portion of the locking teeth 922 on flange 920, thereby fixing the position of the antenna 240 relative to the cover 230 (and chassis 210). Note also that the lock plate 950, along with clip 914, will secure the locking device 900 to the cover 230 (or chassis 210).

In the above-described embodiments, one locking mechanism 290 is associated with each of the antennas 240. However, any suitable type and number of locking mechanisms may be employed, and it is within the scope of the disclosed embodiments that a single locking mechanism may be capable of securing multiple antennas into position.

Embodiments of a wireless access point 200 having one or more antenna locking mechanisms 290 having been herein described, those of ordinary skill in the art will appreciate the advantages of the disclosed embodiments. The disclosed locking mechanisms—which may include one of the locking devices 300, 800, 900—provide a simple and convenient system for securing the antennas of a wireless networking device at a desired position. Human tampering and inadvertent contact are, therefore, prevented or at least minimized. If an antenna requires re-adjustment, the locking mechanism can be easily disengaged to allow for re-positioning of the antenna.

The foregoing detailed description and accompanying drawings are only illustrative and not restrictive. They have been provided primarily for a clear and comprehensive understanding of the disclosed embodiments and no unnecessary limitations are to be understood therefrom. Numerous additions, deletions, and modifications to the embodiments described herein, as well as alternative arrangements, may be devised by those skilled in the art without departing from the spirit of the disclosed embodiments and the scope of the appended claims.

What is claimed is:

1. A wireless networking device, comprising:

a chassis;

an antenna movably coupled with the chassis, wherein the antenna is rotatable relative to the chassis; and a locking mechanism to selectively lock and unlock a position of the antenna relative to the chassis at a desired position in response to placement of a cover on the chassis.

2. The wireless networking device of claim 1, wherein the chassis comprises a wireless access point.

3. A wireless networking device, comprising:

a chassis;

an antenna coupled with the chassis and movable relative to the chassis;

a cover capable of being disposed on the chassis and separated from the chassis; and a locking device coupled with the antenna, the locking device, upon placement of the cover on the chassis, engaging the cover to lock the antenna at a desired position.

4. The wireless networking device of claim 3, wherein the antenna is rotatable relative to the chassis.

5. The wireless networking device of claim 3, wherein the cover is fully separable from the chassis.

6. The wireless networking device of claim 3, wherein the cover is coupled with the chassis by a hinge.

7. The wireless networking device of claim 3, wherein the chassis comprises a wireless access point.

8. An apparatus comprising:

a chassis;

a mounting post extending from the chassis;

an antenna rotationally coupled with the mounting post, the antenna adjustable to a desired position relative to the chassis;

a shroud slidable over the antenna;

a locking element disposed on the shroud;

a cover having an opening to receive the chassis, the cover capable of being placed on the chassis and separated from the chassis; and a mating locking element disposed on the cover;

wherein, when the cover is placed on the chassis, the mating locking element on the cover engages the locking element on the shroud to lock the antenna at the desired position.

9. The apparatus of claim 8, wherein the shroud further includes a clip to engage the mounting post and secure the shroud on the antenna.

10. The apparatus of claim 8, wherein:

the locking element disposed on the shroud comprises a number of locking teeth; and the mating locking element disposed on the cover comprises a number of mating locking teeth, and wherein the mating locking teeth on the cover engage at least a portion of the locking teeth on the shroud upon placement of the cover on the chassis.

11. The apparatus of claim 10, wherein each of the locking teeth on the shroud is positioned on a circumference of a circle having a centerline coincident with a centerline of the mounting post when the shroud is placed over the antenna.

12. The apparatus of claim 11, wherein the number of locking teeth on the shroud comprises 23 teeth extending over approximately 207 degrees of the circle.

13. The apparatus of claim 12, wherein 20 of the 23 teeth extend over approximately 180 degrees of the circle.

14. The apparatus of claim 10, wherein the number of mating locking teeth on the cover is in a range of between one and eight teeth.

15. The apparatus of claim 8, wherein the cover includes a number of retaining elements to secure the cover to the chassis.

16. The apparatus of claim 15, wherein one of the retaining elements comprises a projection extending from the cover that is sized and oriented to mate with a corresponding aperture in the chassis.

17. The apparatus of claim 8, wherein the cover includes a number of registration elements to prevent relative movement between the cover and chassis.

18. The apparatus of claim 17, wherein the number of registration elements comprises at least one of:

a projection extending from an interior wall of the cover that is located and oriented to engage a surface of the chassis;

a rib extending over an interior surface of the cover, at least a portion of the rib engagable with an exterior of the chassis;

a slot in the cover sized and oriented to mate with the mounting post extending from the chassis;

a clip disposed on the cover, the clip to engage the mounting post extending from the chassis.

19. The apparatus of claim 8, further comprising:

a second mounting post extending from the chassis;

a second antenna rotationally coupled with the second mounting post, the second antenna adjustable to a desired position relative to the chassis; and a second shroud slidable over the second antenna, the second shroud having a locking element disposed thereon;

wherein the cover includes a second mating locking element that, when the cover is placed on the chassis, engages the locking element on the second shroud to lock the second antenna at the desired position.

20. The apparatus of claim 8, wherein the shroud comprises a molded plastic material.

21. The apparatus of claim 8, wherein the cover comprises a molded plastic material.

22. The apparatus of claim 8, further comprising a mounting bracket secured to a surface of the chassis.

23. The apparatus of claim 8, wherein the chassis comprises a wireless access point.

24. A method comprising:

adjusting an antenna to a desired position, the antenna movably coupled with a chassis;

placing a shroud on the antenna, the shroud including a number of locking teeth; and positioning a cover on the chassis, the cover including a number of mating locking teeth, the mating teeth on the cover engaging at least a portion of the number of locking teeth of the shroud to lock the antenna at the desired position.

25. The method of claim 24, wherein the antenna is coupled with a mounting post extending from the chassis, the method further comprising securing the shroud to the mounting post.

26. The method of claim 24, further comprising securing the cover to the chassis using a number of retaining elements.

27. The method of claim 24, further comprising securing a position of the cover relative to the chassis using a number of registration elements.

* * * * *